US009381441B1

(12) United States Patent
Jansky

(10) Patent No.: US 9,381,441 B1
(45) Date of Patent: Jul. 5, 2016

(54) TOY VEHICLE DEVICE

(71) Applicant: Jonathan R. Jansky, Hawthorne Woods, IL (US)

(72) Inventor: Jonathan R. Jansky, Hawthorne Woods, IL (US)

( * ) Notice: Subject to any disclaimer, the term of this patent is extended or adjusted under 35 U.S.C. 154(b) by 0 days.

(21) Appl. No.: 14/574,765

(22) Filed: Dec. 18, 2014

(51) Int. Cl.
*A63H 17/00* (2006.01)
*A63H 17/26* (2006.01)
*A63H 29/14* (2006.01)

(52) U.S. Cl.
CPC ..... *A63H 17/26* (2013.01); *A63H 29/14* (2013.01)

(58) Field of Classification Search
CPC ..... A63H 17/00; A63H 17/008; A63H 2018/165; A63H 33/28
USPC ..... 446/16, 193, 267, 457
See application file for complete search history.

(56) References Cited

U.S. PATENT DOCUMENTS

| | | | | | |
|---|---|---|---|---|---|
| 4,347,683 | A * | 9/1982 | Maxim | A63H 3/24 200/61.05 |
| 4,872,680 | A | 10/1989 | Dennis | |
| 5,360,362 | A * | 11/1994 | Cernansky | A63H 7/04 101/328 |
| 5,391,102 | A | 2/1995 | Bosch | |
| 5,746,636 | A * | 5/1998 | Cernansky | A63H 33/28 446/16 |
| 6,419,545 | B1 | 7/2002 | Motosko | |
| D571,413 | S | 6/2008 | Martino | |
| 2010/0009591 | A1 | 1/2010 | Trzecieski | |
| 2012/0058707 | A1 | 3/2012 | Finwall | |

* cited by examiner

*Primary Examiner* — Nini Legesse

(57) ABSTRACT

A toy vehicle assembly includes a housing structured to resemble a vehicle. A plurality of wheels is rotatably coupled to the housing such that each of the wheels may roll along a support surface. A sponge is positioned within the housing wherein the sponge may retain a fluid within the housing. An actuator is coupled to the housing. The actuator is engaged by a user such that the actuator urges the sponge onto the wheels. Thus, the sponge deposits the fluid onto the wheels wherein the wheels may leave skid marks on the support surface when the housing is rolled along the support surface.

3 Claims, 3 Drawing Sheets

TOY VEHICLE DEVICE

BACKGROUND OF THE DISCLOSURE

Field of the Disclosure

The disclosure relates to toy devices and more particularly pertains to a new toy device for leaving vehicle skid marks on a support surface.

SUMMARY OF THE DISCLOSURE

An embodiment of the disclosure meets the needs presented above by generally comprising a housing structured to resemble a vehicle. A plurality of wheels is rotatably coupled to the housing such that each of the wheels may roll along a support surface. A sponge is positioned within the housing wherein the sponge retains a fluid within the housing. An actuator is coupled to the housing. The actuator is engaged by a user such that the actuator urges the sponge onto the wheels. Thus, the sponge deposits the fluid onto the wheels such that the wheels leave skid marks on the support surface when the housing is rolled along the support surface.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
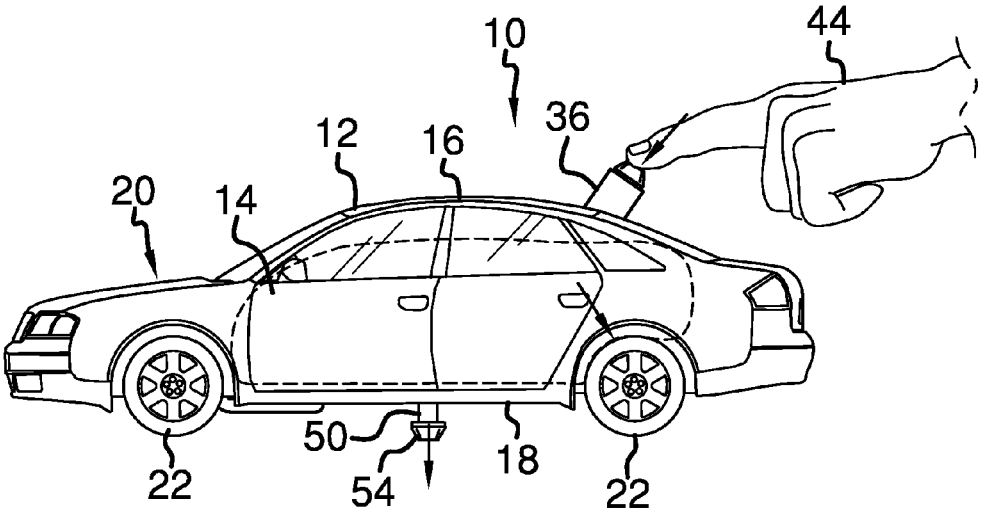
FIG. 1 is a left side view of a toy vehicle assembly according to an embodiment of the disclosure.
Figure 2:
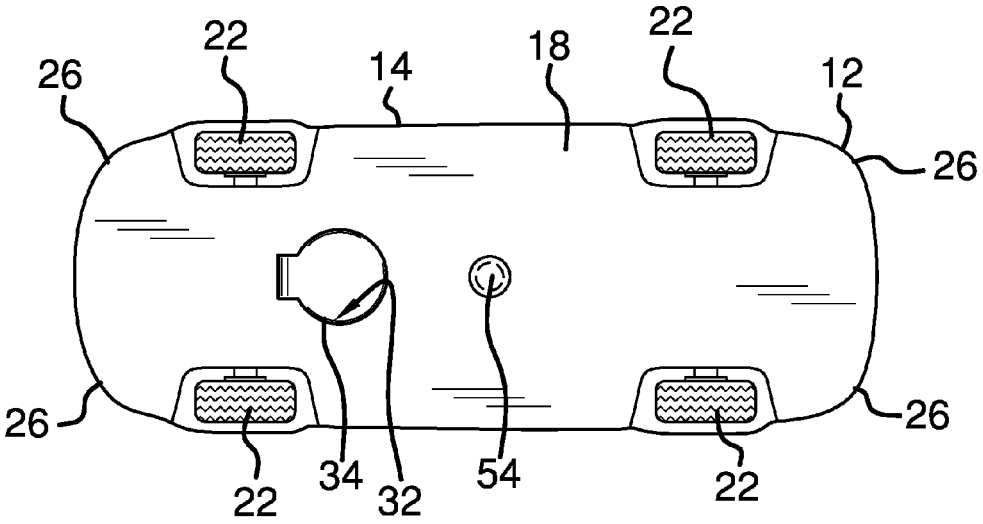
FIG. 2 is a bottom view of an embodiment of the disclosure.
Figure 3:
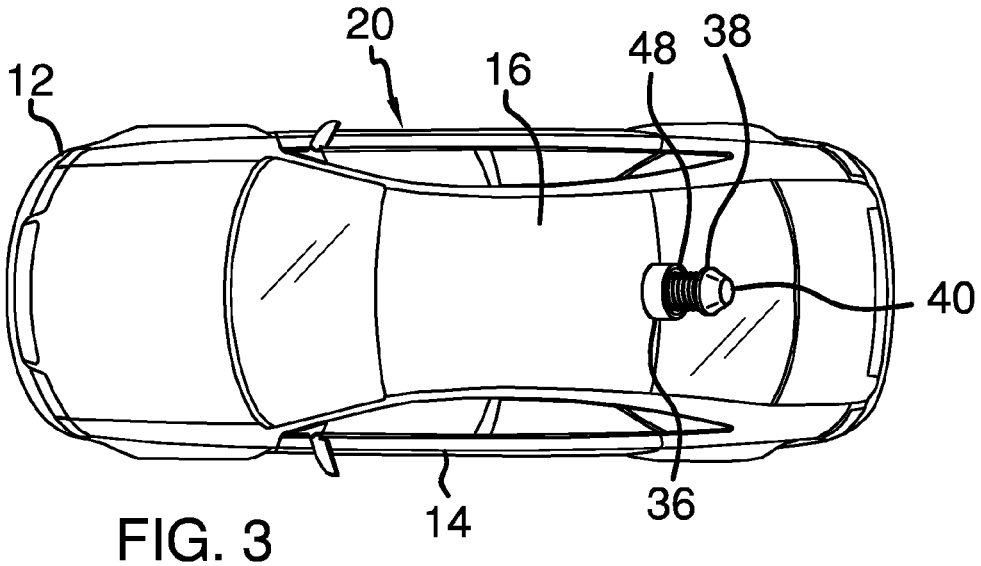
FIG. 3 is a top view of an embodiment of the disclosure.
Figure 4:
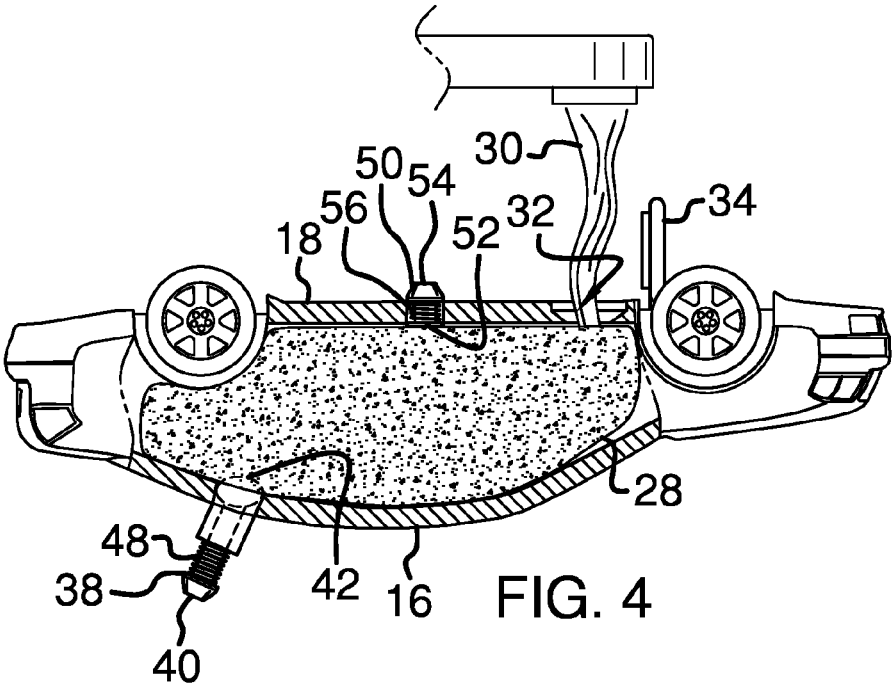
FIG. 4 is a left side cutaway view of an embodiment of the disclosure.
Figure 5:
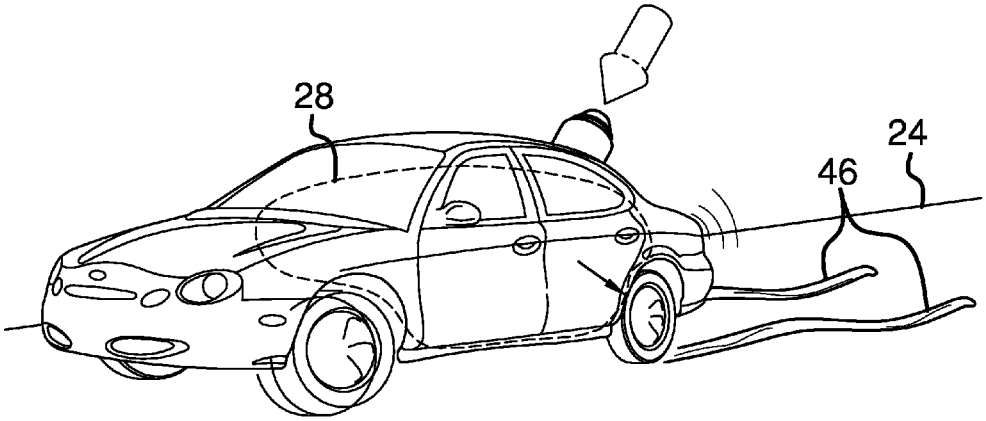
FIG. 5 is an in-use view of an embodiment of the disclosure.

With reference now to the drawings, and in particular to FIGS. 1 through 5 thereof, a new toy device embodying the principles and concepts of an embodiment of the disclosure and generally designated by the reference numeral 10 will be described.

As best illustrated in FIGS. 1 through 5, the toy vehicle assembly 10 generally comprises a housing 12. The housing 12 has an outer wall 14 extending between a top wall 16 and a bottom wall 18 of the housing 12. Additionally, the housing 12 is structured to resemble a vehicle 20. Each of a plurality of wheels 22 is rotatably coupled to the bottom wall 18 of the housing 12 such that each of the wheels 22 can roll along a support surface 24. Each of the wheels 22 is positioned adjacent to an associated one of four corners 26 of the housing 12.

A sponge 28 is positioned within the housing 12. The sponge 28 retains a fluid 30 within the housing 12. The fluid 30 may be water. The bottom wall 18 of the housing 12 has an opening 32 extending therethrough. The opening 32 receives the fluid 30 such that the fluid 30 is absorbed by the sponge 28. A cap 34 is removably coupled to the bottom wall 18 of the housing 12. The cap 34 closes the opening 32.

A sleeve 36 is provided. The sleeve 36 is coupled to the top wall 16 of the housing 12. The sleeve 36 is in fluid communication with an interior of the housing 12. An actuator 38 is provided. The actuator 38 has a top end 40 and a bottom end 42. Moreover, the actuator 38 is elongated between the top 40 and bottom 42 ends.

The bottom end 42 of the actuator 38 is slidably positioned within the sleeve 36. Thus, the bottom end 42 of the actuator 38 extends inwardly into the housing 12 and urges the sponge 28 downwardly onto the wheels 22 when a user 44 engages the top end 40 of the actuator 38. The actuator 38 urges the sponge 28 onto the wheels 22. Consequently, the sponge 28 deposits the fluid 30 onto the wheels 22 wherein the wheels 22 leave skid marks 46 on the support surface 24 when the housing 12 is rolled along the support surface 24. A first spring biasing member 48 is coupled around the actuator 38. The first spring biasing member 48 biases the actuator 38 outwardly from the housing 12.

A post 50 is provided. The post 50 has an upper end 52 and a lower end 54. Additionally, the post 50 is elongated between the upper 52 and lower 54 ends. The upper end 52 of the post 50 is movably coupled to the bottom wall 18 of the housing 12.

A second spring biasing member 56 is coupled around the post 50. The second spring biasing member 56 biases the post 50 upwardly into the housing 12. The upper end 52 of the post 50 urges the sponge 28 upwardly away from the wheels 22. Thus, the sponge 28 does not deposit the fluid 30 onto the wheels 22 until the user 44 engages the actuator 38.

In use, the housing 12 is rolled along the support surface 24. The user 44 engages the actuator 38 when the user 44 wishes to leave the skid marks 46 on the support surface 24. Additional fluid 30 is added through the opening 32 when the sponge 28 is depleted of the fluid 30.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A toy vehicle assembly comprising:

a housing structured to resemble a vehicle, said housing having an outer wall extending between a top wall and a bottom wall of said housing;

a plurality of wheels each being rotatably coupled to said housing such that each of said wheels is configured to roll along a support surface;

a sponge positioned within said housing wherein said sponge is configured to retain a fluid within said housing, said bottom wall of said housing having an opening extending therethrough wherein said opening is configured to receive the fluid such that the fluid is absorbed by said sponge; and an actuator coupled to said housing, said actuator being engaged by a user such that said actuator urges said sponge onto said wheels having said sponge depositing the fluid onto said wheels wherein said wheels are configured to leave skid marks on the support surface when said housing is rolled along the support surface; and a post having an upper end and a lower end, said post being elongated, said upper end of said post being movably coupled to said bottom wall of said housing, said upper end of said post urging said sponge upwardly away from said wheels wherein said sponge does not deposit the fluid onto said wheels until the user engages said actuator.

2. The assembly according to claim 1, further comprising a bottom end of said actuator extending inwardly into said housing and urging said sponge downwardly onto said wheels when the user engages said top end of said actuator.

3. A toy vehicle assembly comprising:

a housing, said housing having an outer wall extending between a top wall and a bottom wall of said housing wherein said housing is structured to resemble a vehicle;

a plurality of wheels each being rotatably coupled to said bottom wall of said housing such that each of said wheels is configured to roll along a support surface;

a sponge positioned within said housing wherein said sponge is configured to retain a fluid within said housing;

said bottom wall of said housing having an opening extending therethrough wherein said opening is configured to receive the fluid such that the fluid is absorbed by said sponge;

an actuator, said actuator having a top end and a bottom end, said actuator being elongated, said bottom end of said actuator being coupled to said top wall of said housing, said bottom end of said actuator extending inwardly into said housing and urging said sponge downwardly onto said wheels when a user engages said top end of said actuator such that said actuator urges said sponge onto said wheels, said sponge depositing the fluid onto said wheels wherein said wheels are configured to leave skid marks on the support surface when said housing is rolled along the support surface; and a post having an upper end and a lower end, said post being elongated, said upper end of said post being movably coupled to said bottom wall of said housing, said upper end of said post urging said sponge upwardly away from said wheels wherein said sponge does not deposit the fluid onto said wheels until the user engages said actuator.

* * * * *